US005944000A

United States Patent [19]

Bieler et al.

[11] Patent Number: 5,944,000

[45] Date of Patent: Aug. 31, 1999

[54] VENTING ARRANGEMENT IN AN INTAKE DUCT OF AN INTERNAL COMBUSTION ENGINE

[75] Inventors: Jens Bieler, Felibach; Peter Werner, Altdorf; Matthias Zentgraf, Kronberg, all of Germany

[73] Assignee: Daimler-Benz AG, Stuttgart, Germany

[21] Appl. No.: 09/064,533

[22] Filed: Apr. 22, 1998

[30] Foreign Application Priority Data

Apr. 23, 1997 [DE] Germany ..... 197 17 040

[51] Int. Cl.[6] ..... F01M 13/00

[52] U.S. Cl. ..... 123/572

[58] Field of Search ..... 123/572, 573, 123/574, 184.21

[56] References Cited

U.S. PATENT DOCUMENTS 1,525,882 2/1925 Padgett ..... 123/572

4,024,846 5/1977 MacGuire ..... 123/574

5,794,602 8/1998 Kimura ..... 123/572

*Primary Examiner*—Marguerite McMahon

*Attorney, Agent, or Firm*—Klaus J. Bach

[57] ABSTRACT

In a venting arrangement for an internal combustion engine having a cylinder head with an intake duct structure consisting of plastic material and including intake passages, an inlet stub for connection to a vent pipe, and an outlet for communication with the intake passages, the intake duct structure includes a passage with a metal sleeve and a bolt extending through the metal sleeve for mounting the intake duct structure to the cylinder head while firmly engaging the metal sleeve with the cylinder head and a throttle structure which limits the vent flow from the inlet stub to the outlet intake ducts is formed in the passage adjacent the metal sleeve so as to be heated by the metal sleeve.

4 Claims, 2 Drawing Sheets

VENTING ARRANGEMENT IN AN INTAKE DUCT OF AN INTERNAL COMBUSTION ENGINE

BACKGROUND OF THE INVENTION

The invention relates to a venting arrangement in a vent pipe leading to an intake duct structure of an internal combustion engine, which intake duct structure consists of a plastic pipe with a heat conductive metal sleeve mounted in a passage formed in the plastic pipe and a throttle forming a flow limiter.

Such venting arrangements with throttles serving as flow limiters are used for example in the C and E class of passenger cars of the assignee of the present application. These cars include multi-cylinder internal combustion engines with crankcases having vent lines extending therefrom and being flanged to a plastic intake duct. In the outer accessible part of the vent line between the crankcase and the intake duct, there is arranged a throttle which controls the gas flow volume through the vent line.

However, with these arrangements functional problems occurred at low ambient temperatures whereby proper crankcase venting was not insured.

It is therefore the object of the present invention to provide a venting arrangement with simple means by which functional problems or even failures of the crankcase venting system are prevented.

SUMMARY OF THE INVENTION

In a venting arrangement for an internal combustion engine having a cylinder head with an intake duct structure consisting of plastic material and including intake passages, an inlet stub for connection to a vent pipe, and an outlet for communication with the intake passages, the intake duct structure includes a passage with a metal sleeve and a bolt extending through the metal sleeve for mounting the intake duct structure to the cylinder head while firmly engaging the metal sleeve with the cylinder head and a throttle structure which limits the vent flow from the inlet stub to the outlet and to the intake ducts is formed in the passage adjacent the metal sleeve so as to be heated by the metal sleeve.

By providing a thermally conductive connection between warm engine operating components by way of the metal sleeve which is in contact with the cylinder head for conducting heat to the throttle, the freezing of the flow limiting throttle is prevented in a very simple manner. There is no need for additional components. Rather, a metal sleeve used in the past as a spacing member is now arranged in contact with the cylinder head to be heated thereby and make the throttle portion of the vent line insensitive to low ambient temperatures.

In an advantageous embodiment of the invention, the throttle is integrated into the metal sleeve as a conducting part thereof. In this way, its temperature can rapidly increased with the engine operating temperature even during the warm up phase of the engine at very low ambient temperature and a cold engine.

The invention will be described in greater detail on the basis of the accompanying drawings.

DESCRIPTION OF A PREFERRED EMBODIMENT

Figure 1:
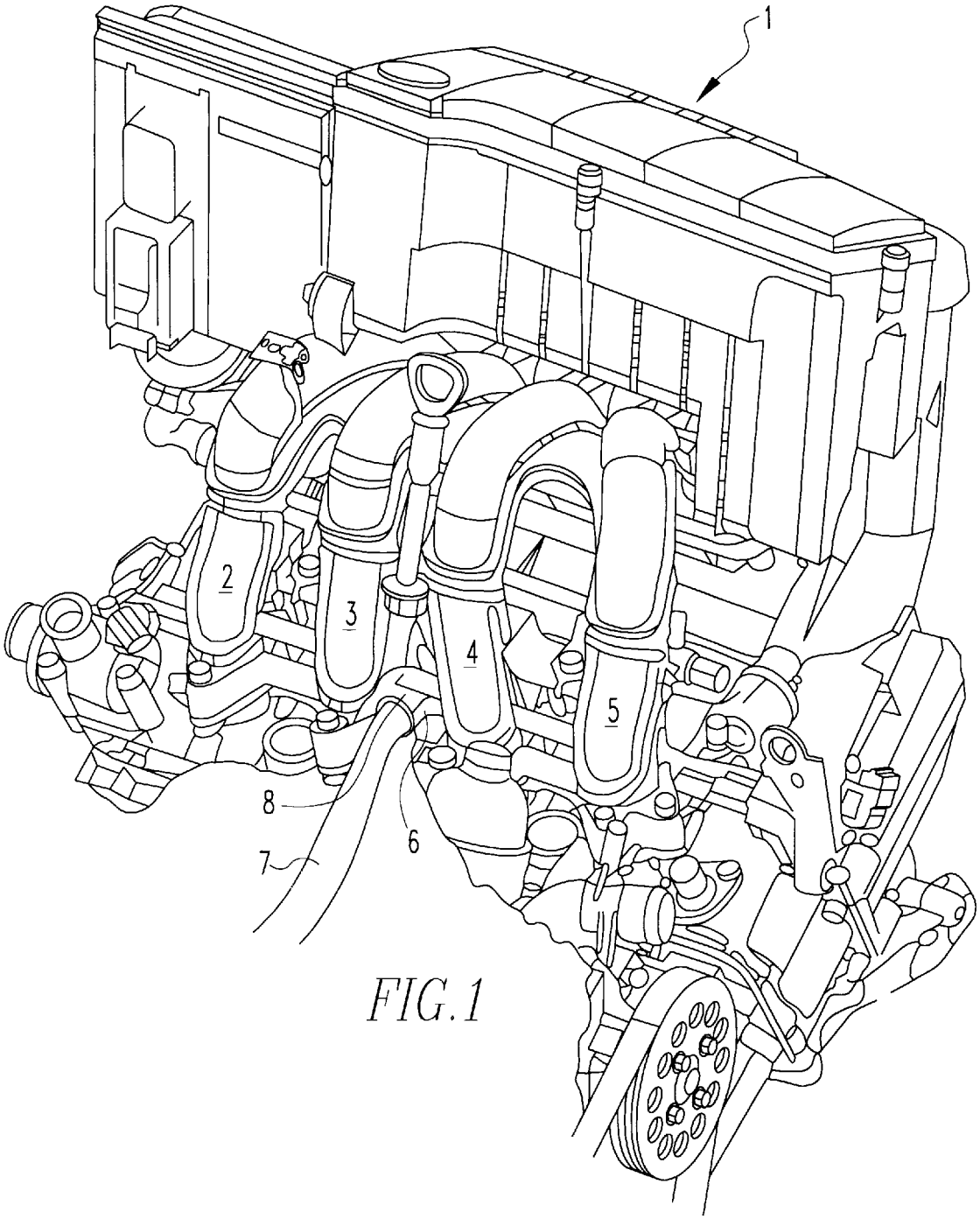
FIG. 1 shows a venting arrangement connected to the intake duct structure of a four-cylinder internal combustion engine with an exposed vent line.

As shown in FIG. 1*a,* a four-cylinder internal combustion engine 1 with four intake ducts 2, 3, 4, 5 arranged side-by-side includes a vent line 7 leading from the engine crankcase to the intake duct structure 6 for venting the crankcase. Between the adjacent inner intake ducts 3, 4, the vent line 7 is connected to an inlet stub 8 of the intake duct structure 6, which consists of plastic material.

Figure 2:
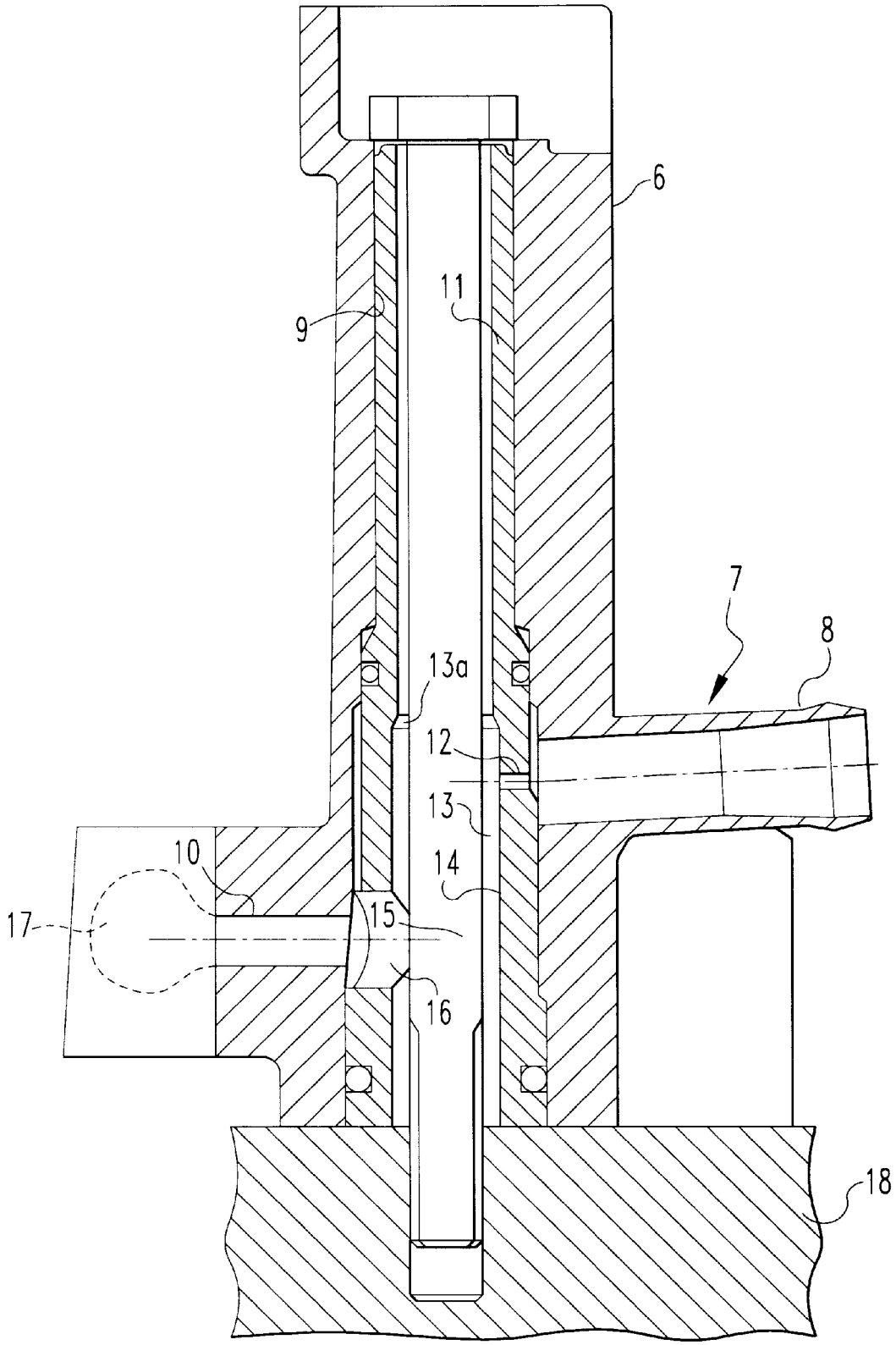
FIG. 2 shows, in an enlarged representation, a throttle arrangement in a metal sleeve which is arranged in heat conductive contact with the cylinder head.

The intake duct structure 6 includes a stepped elongated passage 9, which is crossed by the vent line 7 at its lower end (FIG. 2). The inlet stub 8 of the vent line 7 leads radially into the passage 9. An outlet 10 extends radially from the passage 9 in axially spaced relationship from the inlet stub 8, the inlet stub 8 being arranged at a higher level that is at a greater distance from the engine then the outlet 10.

In the elongated passage 9, there is disposed a metal sleeve 11, which acts as a spacer and which extends over the full length of the elongated passage 9. In the area of the inlet stub 8, the metal sleeve 11 includes a throttle 12 which is disposed at the geodetically highest point of the crankcase venting system. The throttle 12 is formed by a radial bore in the metal sleeve 11 which bore is in alignment with the inlet stub 8. The bore 12 provides for communication between the inlet stub 8 and an intermediate annular space 13 defined by the inner wall 14 of the metal sleeve 11 and a mounting bolt 15 extending through the metal sleeve 11. The annular space 13 extends from a point 13*a* above the throttle 12 to the lower end of the metal sleeve 11.

In alignment with the outlet passage 10, a relatively large radial bore 16 extends through the metal sleeve 11, which provides for communication between the annular space 13 the outlet passage 10 which leads to a collecting pipe 17 connected to all the intake ducts 2 to 5.

The intake duct structure 6 which consists of plastic is mounted onto the cylinder head 18 of the internal combustion engine by the mounting bolt 15, which, at the same time, firmly engages the sleeve 11 with the cylinder head 18 so that heat is conducted from the cylinder head 18 by way of the metal sleeve 11 to the area of the throttle 12 whereby freezing of the throttle is prevented.

What is claimed is:

1. A venting arrangement in an intake duct structure including intake passages of an internal combustion engine having a cylinder head, said intake duct structure comprising a plastic material component including an inlet stub for connection to a vent pipe and an outlet for communication with said intake passages, said plastic material component including a passage extending therethrough, a metal sleeve extending through said passage, a bolt extending through said metal sleeve for mounting said plastic material component onto said cylinder head by way of said metal sleeve whereby said metal sleeve is in firm heat transfer contact with said cylinder head, and a throttle structure for limiting vent gas flow from said inlet stub to said outlet formed in said passage adjacent said metal sleeve so as to be exposed to the heat transferred from said cylinder-head to said metal sleeve.

2. A venting arrangement according to claim 1, wherein said vent gas flow extends from said inlet stub to said outlet through said metal sleeve and said throttle structure is formed integrally with said metal sleeve.

3. A venting arrangement according to claim 2, wherein said throttle is formed in said metal sleeve in alignment with said inlet stub and leads to an annular space formed between said bolt and said metal sleeve and said metal sleeve further includes a radial bore of a diameter larger than said throttle and arranged in alignment with said outlet so as to provide for communication between said annular space and said outlet.

4. A venting arrangement according to claim 2, for a multi-cylinder internal combustion engine having a number of intake ducts corresponding to the number of cylinders of said engine, said inlet stub and said throttle structure being arranged between two adjacent intake ducts in the center of said number of intake ducts and said throttle is disposed at the geodetically highest point of said vent gas flow.

* * * * *